US007070306B2

(12) United States Patent
Cousin

(10) Patent No.: US 7,070,306 B2
(45) Date of Patent: Jul. 4, 2006

(54) ASSEMBLY FOR MOUNTING A SELF-SUPPORTING SPOTLIGHT ON A STRETCHED CEILING

(75) Inventor: Etienne Cousin, Haubourdin (FR)

(73) Assignee: Newmat, S.A., Haubourdin (FR)

( * ) Notice: Subject to any disclaimer, the term of this patent is extended or adjusted under 35 U.S.C. 154(b) by 47 days.

(21) Appl. No.: 10/332,664

(22) PCT Filed: May 21, 2002

(86) PCT No.: PCT/FR02/01709

§ 371 (c)(1),
(2), (4) Date: Feb. 14, 2003

(87) PCT Pub. No.: WO02/095286

PCT Pub. Date: Nov. 28, 2002

(65) Prior Publication Data

US 2004/0011936 A1 Jan. 22, 2004

(30) Foreign Application Priority Data

May 22, 2001 (FR) ..... 01 06744

(51) Int. Cl.
*F21V 15/00* (2006.01)

(52) U.S. Cl. ..... 362/365; 362/366; 362/404; 362/457; 362/458

(58) Field of Classification Search ..... 248/224.7, 248/222.52, 223.41, 343; 362/470, 369, 362/267, 285, 365, 366, 404, 457, 458
See application file for complete search history.

(56) References Cited

U.S. PATENT DOCUMENTS

| | | | | |
|---|---|---|---|---|
| 4,223,861 | A * | 9/1980 | Guggemos et al. | 248/222.52 |
| 6,241,369 | B1 * | 6/2001 | Mackiewicz | 362/368 |
| 6,250,776 | B1 * | 6/2001 | Burkitt et al. | 362/267 |
| 6,367,945 | B1 * | 4/2002 | Quiogue et al. | 362/147 |
| 6,533,441 | B1 * | 3/2003 | Kisiel | 362/470 |
| 6,554,457 | B1 * | 4/2003 | Platt | 362/365 |
| 6,652,124 | B1 * | 11/2003 | Schubert et al. | 362/285 |
| 2003/0067778 | A1 * | 4/2003 | Vernusset et al. | 362/365 |

FOREIGN PATENT DOCUMENTS

| | | | |
|---|---|---|---|
| EP | 621442 | A1 * | 10/1994 |
| FR | 2 770 619 | A | 5/1999 |
| GB | 2 043 369 | A | 10/1980 |
| JP | 05217411 | A * | 8/1993 |

* cited by examiner

*Primary Examiner*—Sandra O'Shea
*Assistant Examiner*—Anabel Ton
(74) *Attorney, Agent, or Firm*—Ladas & Parry LLP

(57) ABSTRACT

An assembly for mounting a self-supporting spotlight to a tensioned ceiling, the assembly comprises a reinforcing washer stuck to the front face of the sheet forming the ceiling, and a spotlight having at least one bulb and a spotlight collar suitable for fastening to the reinforcing washer. According to the invention, the spotlight collar has first fastening means and the reinforcing washer has second fastening means, said first and second fastening means being suitable for co-operating in reversible manner on turning the collar through an angle relative to the washer for the purposes of locking and unlocking them.

6 Claims, 2 Drawing Sheets

ASSEMBLY FOR MOUNTING A SELF-SUPPORTING SPOTLIGHT ON A STRETCHED CEILING

BACKGROUND OF THE INVENTION

The present invention relates to the field of small lamps of the kind commonly referred to as spotlights that are intended more particularly for mounting to a tensioned ceiling, i.e. a ceiling constituted by a sheet of plastics material, generally polyvinyl chloride (PVC), mounted under tension by appropriate means.

It is now becoming more and more commonplace to mount bulbs for lighting or "spotlights" by fitting them directly to the ceiling. Under such circumstances, the bulb is substantially flush with the plane of the ceiling and is surrounded by an annular collar for finishing off the visual appearance of the hole made in the ceiling where the bulb is received.

With a tensioned ceiling, a spotlight is put into place by means firstly of a reinforcing washer and secondly of a structural element referred to as a spot plate. The reinforcing washer is stuck to the visible face of the tensioned ceiling. It is annular in shape with a circular inside opening within which the sheet constituting the ceiling is pierced. The reinforcing washer serves mainly to prevent any damage to the sheet while cutting out the opening for passing the bulb.

The structural element or "spot plate" is fixed rigidly above the tensioned ceiling. It carries an electrical transformer and comprises a plate that comes up to the rear face of the tensioned ceiling, said plate itself being partially open to receive the bulb.

In order to be fixed on top of the reinforcing washer, the collar of the spotlight is fitted with snap-fastening means suitable for coming down onto the back face of the plate of the structural element. Thus, after the bulb has been inserted and fixed onto the collar, the collar and the bulb are themselves supported by the fixed structural element.

The drawback of that solution lies mainly in the need to install a structural element that is to be fixed rigidly, thereby complicating the fitting of spotlights and making such fitting more expensive. In addition, it is not very easy to remove the spotlight, since after the bulb has been taken away it is necessary to have access to the snap-fastening means which are on the rear face of the structural element.

A more simple solution has already been proposed in which the collar of the spotlight is not supported by a fixed structural element but is supported by the tensioned ceiling itself. In that solution, the collar of the spotlight is provided with tongues that can be folded down. The tongues have a first position in which they penetrate through the opening formed in the tensioned ceiling in the central portion of the reinforcing washer, and a second position in which they are folded down against the rear face of the tensioned ceiling, in the zone that is stuck to the reinforcing washer. It is thus in this second position that the collar of the spotlight is held in place, being supported by the tensioned ceiling via the reinforcing washer.

Nevertheless, that new solution is not completely satisfactory. The manufacture of a collar with tongues that can be folded down is more complex. In addition, removing a collar that has already been installed in a tensioned ceiling is difficult since it is possible to access the folded-down tongues only via the central opening in the collar. Finally, while they are being manipulated, the tongues can break in their hinge-forming zones.

OBJECTS AND SUMMARY OF THE INVENTION

The object that the Applicant seeks to achieve is to provide an assembly for mounting a self-supporting spotlight in a tensioned ceiling that mitigates the above-mentioned drawbacks.

This object is achieved by the assembly of the invention which comprises, in conventional manner, a reinforcing washer stuck to the sheet forming the ceiling, and a spotlight comprising at least one bulb and a spotlight collar suitable for fastening to the reinforcing washer. In characteristic manner, according to the invention, the spotlight collar has first fastening means and the reinforcing washer has second fastening means, said first and second fastening means being suitable for co-operating in reversible manner on turning the collar through an angle relative to the washer for the purposes of locking and unlocking them.

Thus, in the particular disposition of the invention, it suffices to press the spotlight collar against the reinforcing washer and to turn said collar through an angle about the axis of symmetry of the washer in order to reach a locked position. The unlocked position is reached by turning through the same angle in the opposite direction.

The spotlight collar has a plane annular face presenting at least one flange, and the reinforcing washer is of plane annular shape, being of a size to leave clearance when received around said flange against a plane face forming the web of the ceiling; the first fastening means consist in at least one stud projecting outwards from the flange of the collar; the second fastening means consist, for each stud, in an inside cutout configured to allow the stud to pass through while the collar is being put into place so as to occupy a position above the reinforcing washer; and the stud is situated at a distance H from the web of the collar, which distance is perceptibly greater than the thickness e of the reinforcing washer.

Under such circumstances, it is the stud which penetrates through the cutout and then takes up position over the reinforcing washer after being turned through an angle, and thus serves to suspend the collar on the reinforcing washer.

In order to ensure that such suspension is balanced, it is preferable for there to be two studs and two cutouts, disposed diametrically about the axis of symmetry of the collar and of the reinforcing washer.

Naturally, the number of studs and cutouts may be greater, in which case they should be disposed symmetrically about the axis of the collar and the washer. Such symmetrical distribution is preferred in order to obtain uniform distribution of the weight of the spotlight over the reinforcing washer. Nevertheless, it may also be preferred to use a distribution that is not symmetrical, should it be desirable to facilitate accurate positioning of the collar relative to the washer in a determined direction.

In a preferred embodiment, the stud has an inclined face for rubbing against the washer while the collar is being turned through an angle. The purpose of this inclined face is to jam the collar by taking up the clearance that exists between said collar and the reinforcing washer.

In a particular embodiment, the stud is of conical overall shape and is obtained by embossing the metal constituting the collar.

In general, the collar presents two flanges, one on the inside terminated by a rim which serves as a housing for the bulb, and the other on the outside which hides the reinforcing washer. The outside flange is preferably of height h which is less than the thickness e of the washer. By means of this particular disposition, the outside flange never comes into contact with the tensioned ceiling, thus avoiding any risk of melting the sheet that constitutes the tensioned ceiling, particularly when it is made of PVC, given that the collar of the spotlight can become hot when the bulb remains switched on continuously.

BRIEF DESCRIPTION OF THE DRAWINGS

The present invention will be better understood on reading the following description of a preferred embodiment of an assembly for mounting a self-supporting spotlight to a tensioned ceiling, as shown in the accompanying drawings, in which.

MORE DETAILED DESCRIPTION

Figure 1:
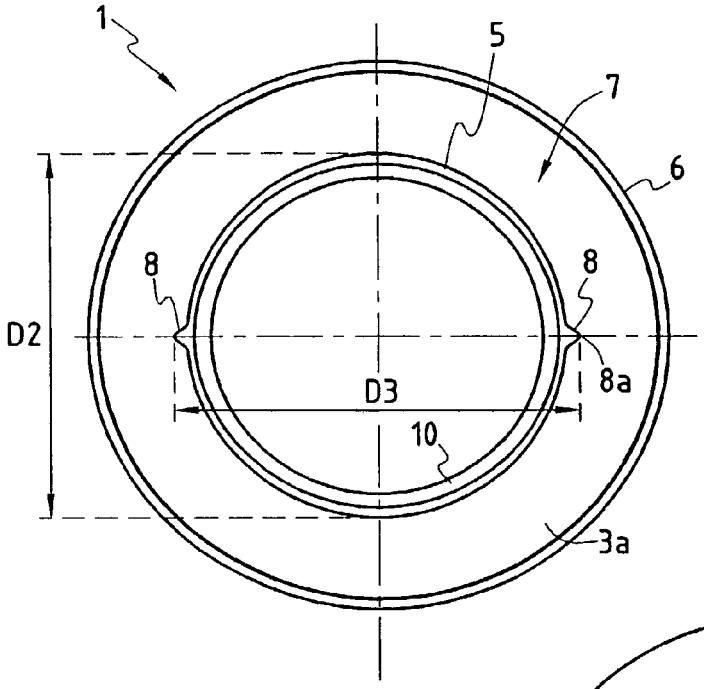
FIG. 1 is a plan view from beneath of a spotlight collar fitted with two studs.
Figure 2:
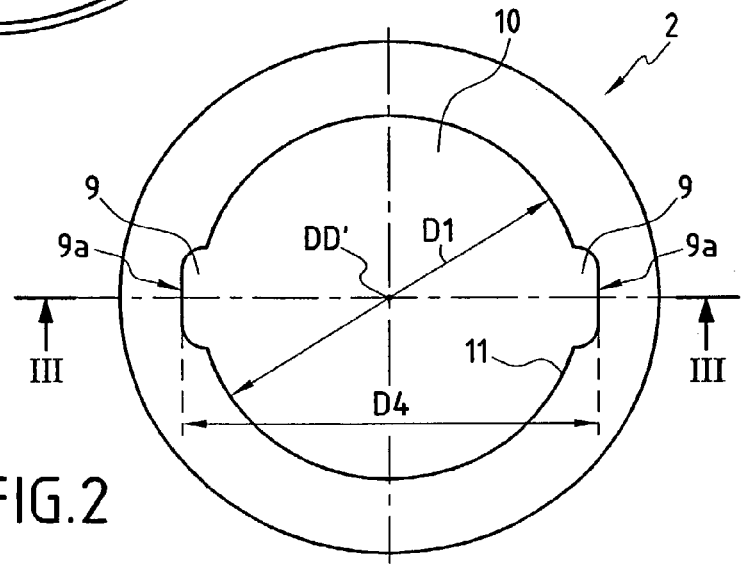
FIG. 2 is a plan view of the reinforcing washer presenting two inside cutouts.

A self-supporting spotlight for a tensioned ceiling comprises a bulb (not shown) which is snapped into a spotlight collar 1, which collar is suitable for being secured to a reinforcing washer 2, itself stuck to the sheet 4 that is to constitute the tensioned ceiling. The collar 1 has a substantially annular plane face 3 which is the face that is visible when the spotlight is put into place in the tensioned ceiling. This annular face 3 lies between two flanges 5, 6, i.e. two flanges extending substantially perpendicularly to the plane of the face 3 and thus to the tensioned ceiling. These comprise an inside flange 5 which is terminated by a rim 10 that is used as a housing for the bulb, and an outside flange 6 which acts as a mask to hide the reinforcing washer as explained below.

The reinforcing washer 2 is likewise annular in shape. By way of example it is made of a rigid plastics material, such as polycarbonate. Its annular shape is designed so that said washer 3 can be placed without stress, i.e. leaving a certain amount of clearance, inside the space 7 which is defined between the two flanges 5 and 6 and the web 3*a* of the collar 1.

In a manner that is characteristic of the invention, the inside flange 5 of the collar 1 is provided with two studs 8, e.g. obtained by embossing the metal from which said collar 1 is made. Each stud is formed at a distance H from the web 3*a* defining the space 7, where H is substantially greater than the thickness e of the washer 2, plus, where appropriate, the thickness of the sheet 4 forming the tensioned ceiling.

The washer 2 has two inside cutouts 9 which are defined so as to allow the studs 8 to pass through while the collar 1 is being put into place against the reinforcing washer 2. In contrast, the diameter D1 of the inside opening 10 through the washer is greater than the outside diameter D2 of the inside flange 5, but is less than the distance D3 between the tips 8*a* of the two studs 8.

Figure 3:
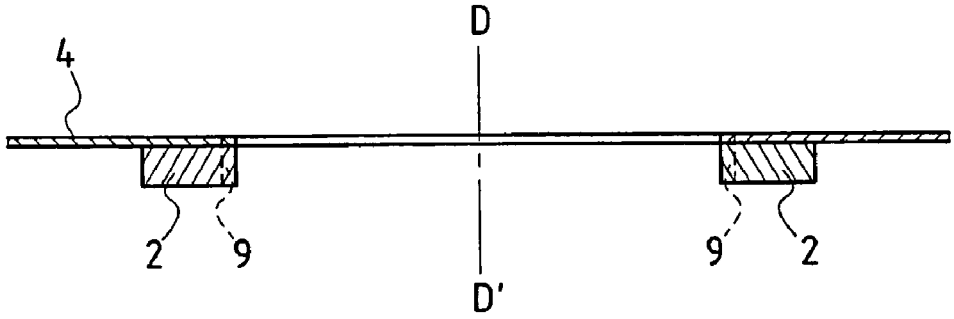
FIGS. 3 and 4 are diagrammatic cross-section views of the washer on axis III—III of FIG. 2 shown stuck to the ceiling sheet, respectively before (FIG. 3) and after (FIG. 4) the sheet has been cut away from the central opening of the washer.
Figure 4:
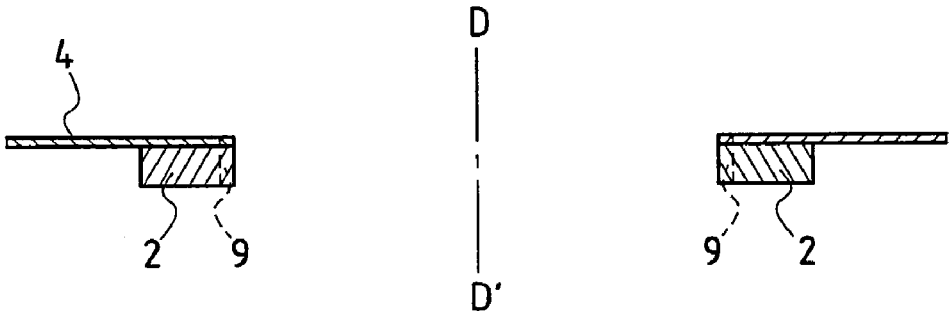

In practice, the reinforcing washers 2 are initially stuck to the front face 4*a* of the sheet 4 at the locations where self-supporting spotlights are to be installed (FIG. 3). Thereafter, the sheet is cut away inside the central opening 10 of each reinforcing washer 2 so as to leave a through opening for the collar 1 and the bulb (FIG. 4).

Figure 6:
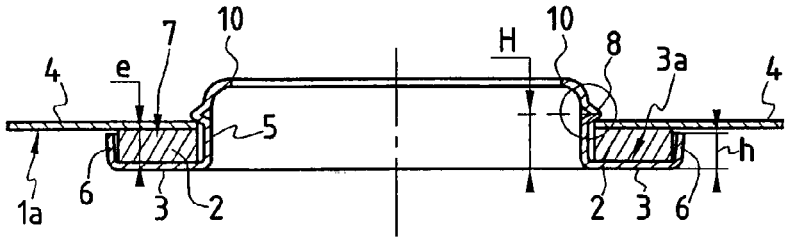
FIG. 6 is a diagram showing the spotlight collar of FIG. 5 after it has been put into place and turned through an angle.
Figure 5:
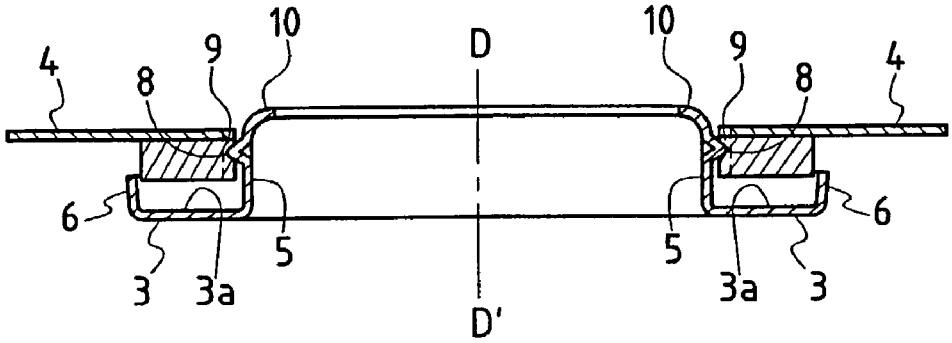
FIG. 5 is a diagram showing the spotlight collar being inserted into the reinforcing washer of FIG. 4.

FIGS. 5 and 6 show a collar 1 being put into place. The collar 1 is positioned in such a manner that the studs 8 are in register with the inside cutouts 9, and the collar 1 is then pressed against the reinforcing washer 2 until the studs 8 have gone right through the cutouts 9 and until the bottom face 2*a* of the washer comes to bear against the web 3*a* of the collar 1. The collar is then turned through an angle about the axis of symmetry DD' of the washer 2. This causes the stud 8 to pass above the reinforcing washer 2, and also over the portion, if any, of the sheet 4 that is stuck to said washer 2, thereby suspending the collar 1 from the tensioned ceiling.

Figure 7:
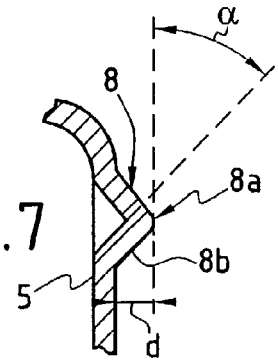
FIG. 7 is a fragmentary section view of the inside flange of the spotlight collar on a plane containing the conical stud.

Preferably, and as shown in the figures, in particular in FIG. 7, the stud 8 has an inclined face 8*b* facing towards the web 3*a* of the collar 1, this inclined face being obtained, for example, by embossing the metal from which said collar 1 is made into the form of a cone. In the example shown in FIG. 7, the angle of inclination $\alpha$ of the inclined face 8*b* relative to the flange 5 is about 45°, for a stud 8 that projects over a distance d of about 3 millimeters (mm). In this same example, the inside diameter D1 of the washer 2 is about 55 mm, the outside diameter D2 of the flange 5 is about 53 mm, the distance D3 between the tips 8*a* of the two studs 8 is about 58 mm, and the distance D4 between the bottoms 9*a* of the two cutouts 9 in the washer 2 is about 60 mm.

The height H, i.e. the distance between the tip 8*a* of the stud 8 and the web 3*a* of the collar 1 is about 6 mm and the thickness e of the washer 2, plus the thickness of the sheet 4 stuck to said washer 2, where appropriate, is about 5 mm.

Under such conditions, it will be understood that once the inside flange 5 of the collar has been inserted through the central opening 10 of the washer, the tips 8*a* of the studs 8 project very slightly over the rear face of the washer or the tensioned ceiling. When the collar 1 is turned through an angle, the inclined faces 8*b* of the two studs come to bear against the top edge 11 of the washer 2, i.e. its edge which is level with the sheet 4 and runs around the inside opening 10 of the washer 2. This causes the collar 1 to be held in position by the studs 8 becoming jammed against said edge 11. Such jamming can occur after turning through different angles depending on the washers and collars in question, as a function of manufacturing tolerances. It is the inclined face 8*b* which performs this necessary function of taking up manufacturing tolerances.

It should be observed that the tension to which the sheet 4 is subjected when the tensioned ceiling is put into place is sufficient for there to be no risk of said sheet deforming, whether merely because of the spotlight being suspended therefrom, or indeed because of the collar being turned through an angle for locking or unlocking purposes relative to the reinforcing washer.

As can be seen clearly in FIG. 6, it is preferable for the height h of the outside flange 6 of the collar to be such as to avoid any contact between said flange 6 and the sheet 4 so as to avoid any risk of said sheet being damaged in the event of the metal collar 1 heating up because of the spotlight being left on for along period of time. This height h is smaller than the thickness e of the washer 2.

The present invention is not limited to the particular embodiment described by way of non-limiting example. In particular, other systems for obtaining locking by turning through an angle could be implemented, e.g. by analogy with bayonet-type sockets.

What is claimed is:

1. A light assembly for a tensioned ceiling, the assembly comprising a reinforcing washer stuck to the front face of the sheet forming the ceiling, and a light collar suitable for fastening to the reinforcing washer, wherein the light collar has first fastening means and the reinforcing washer has second fastening means, said first and second fastening means being suitable for co-operating in reversible manner on turning the collar through an angle relative to the washer for the purposes of locking and unlocking them; wherein a locked position is reached by pressing the light collar against the reinforcing washer and the light collar is turned through said angle about an axis of symmetry of the reinforcing washer; wherein an unlocked position is reached by turning the light collar through said angle in an opposite direction to which the light collar was turned to reach the locked position; wherein the light collar is introduced through a central opening of the reinforcing washer.

2. The light assembly according to claim 1, wherein the light collar has a plane annular face presenting at least one flange, and the reinforcing washer is of plane annular shape, being of a size to leave clearance when received around said flange against a plane face forming the web of the ceiling; the first fastening means consist in at least one stud projecting outwards from the flange of the collar; the second fastening means consist, for each stud, in an inside cutout configured to allow the stud to pass through while the collar is being put into place so as to occupy a position above the reinforcing washer; and the stud is situated at a distance H from the web of the collar, which distance is greater than the thickness e of the reinforcing washer, plus the thickness of the sheet of the tensioned ceiling.

3. The light assembly according to claim 2, having two studs and two cutouts disposed diametrically opposite about the axis of symmetry of the collar and of the reinforcing washer.

4. The light assembly according to claim 2, wherein the stud has an inclined face for rubbing against the washer while the collar is being turned through an angle.

5. The light assembly according to claim 4, wherein the stud is of conical overall shape and is obtained by embossing the metal constituting the collar.

6. The light assembly according to claim 1, wherein the collar presents two flanges, an inside flange terminated by a rim which serves as a housing for a light bulb, and an outside flange which enables the reinforcing washer to be hidden, the outside flange being of a height h which is less than the thickness e of the washer.

* * * * *